US008262368B2

(12) United States Patent
Kane et al.

(10) Patent No.: US 8,262,368 B2
(45) Date of Patent: Sep. 11, 2012

(54) HYDRAULIC PISTON MACHINE

(75) Inventors: Brian Kane, Lohr Am Main (DE); Thomas Seufert, Frammersbach (DE)

(73) Assignee: Robert Bosch GmbH, Stuttgart (DE)

( * ) Notice: Subject to any disclaimer, the term of this patent is extended or adjusted under 35 U.S.C. 154(b) by 433 days.

(21) Appl. No.: 12/521,127

(22) PCT Filed: Oct. 30, 2007

(86) PCT No.: PCT/EP2007/009392

§ 371 (c)(1),
(2), (4) Date: Jun. 25, 2009

(87) PCT Pub. No.: WO2008/080445

PCT Pub. Date: Jul. 10, 2008

(65) Prior Publication Data

US 2010/0068076 A1 Mar. 18, 2010

(30) Foreign Application Priority Data

Jan. 5, 2007 (DE) ..... 10 2007 001 793

(51) Int. Cl.
*F04B 1/12* (2006.01)
*F04B 27/08* (2006.01)
*F04B 1/26* (2006.01)

(52) U.S. Cl. ..... 417/269; 417/271; 417/488; 92/70; 92/71; 92/75

(58) Field of Classification Search ..... 417/269, 417/271, 488; 92/70, 71
See application file for complete search history.

(56) References Cited

U.S. PATENT DOCUMENTS

| | | | | | |
|---|---|---|---|---|---|
| 1,613,116 | A | * | 1/1927 | Maldon | 123/51 BA |
| 1,819,966 | A | | 8/1931 | Olson | |
| 2,842,068 | A | * | 7/1958 | Olov | 417/269 |
| 3,018,737 | A | * | 1/1962 | Cook et al. | 74/60 |
| 3,172,368 | A | * | 3/1965 | Mashiater | 417/269 |
| 4,041,843 | A | * | 8/1977 | Mischenko et al. | 91/499 |
| 4,275,998 | A | | 6/1981 | Petersson | |
| 4,284,391 | A | | 8/1981 | Williamson | |
| 5,975,863 | A | * | 11/1999 | Mazzucato | 417/269 |
| 6,048,176 | A | * | 4/2000 | Deininger | 417/222.1 |
| 6,079,961 | A | * | 6/2000 | Schuller et al. | 417/549 |
| 6,189,434 | B1 | * | 2/2001 | Kawaguchi et al. | 92/71 |
| 6,293,514 | B1 | * | 9/2001 | Pechoux et al. | 251/122 |

(Continued)

FOREIGN PATENT DOCUMENTS

DE 197 45 751 5/1999

(Continued)

*Primary Examiner* — Charles Freay
*Assistant Examiner* — Christopher Bobish
(74) *Attorney, Agent, or Firm* — Michael J. Striker

(57) ABSTRACT

A hydraulic piston machine includes a plurality of pistons (12, 14) which are driven by a drive/output shaft (40), guided in an axially displaceable manner in a piston barrel (4) of a housing (2), and, in each case, bound one working chamber (44) into which the pressure medium may be fed via a suction valve (46), and from which the pressure medium may be discharged via a pressure valve (48). The housing (2) includes at least one further housing part (6) which is connected to the piston barrel (4) on the front side. The suction valves (46) and pressure valves (48) are situated in the region of a parting plane (50) between the housing parts (4, 6), in housing receptacles (52, 54), approximately axially parallel to the longitudinal axis of the piston machine.

17 Claims, 8 Drawing Sheets

U.S. PATENT DOCUMENTS 6,368,072 B1 * 4/2002 Inoue et al. ..... 417/269

FOREIGN PATENT DOCUMENTS

| | | |
|---|---|---|
| DE | 198 09 592 | 9/1999 |
| DE | 10 2004 060 954 | 6/2006 |
| FR | 1 224 096 | 6/1960 |
| GB | 836 327 | 6/1960 |

* cited by examiner

HYDRAULIC PISTON MACHINE

CROSS-REFERENCE

The invention described and claimed hereinbelow is also described in PCT/EP2007/009392, filed on Oct. 30, 2007 and DE 10 2007 001 793.8, filed on Jan. 5, 2007. This German Patent Application, whose subject matter is incorporated here by reference, provides the basis for a claim of priority of invention under 35 U.S.C. 119 (a)-(d).

BACKGROUND OF THE INVENTION

The present invention relates to a hydraulic piston machine.

DE 10 2004 060 954 A1, for example, shows a dual wobble-plate machine, in which a plurality of pistons is accommodated in a stationary barrel, the pistons being guided in pairs in opposite directions in the barrel and bounding a common working chamber. The axial displacement of the opposing pistons takes place using two wobble plates which are situated on either side of the barrel and are non-rotatably connected to a drive shaft. Each piston bears via a sliding block having a through-bore against the wobble plate assigned to it. A capillary tube passes through the piston, via which the pressure medium is directed to the sliding surface of the sliding block, thereby supporting the sliding block in a hydrostatic manner. In this known solution, the pressure medium is supplied to the working chambers via a suction valve accommodated on each of the end sections of the pistons that face the working chambers, each suction valve bounding a pressure chamber which is connected via inclined bores formed in the piston foot to suction connections of the axial piston machine. Pressure valves which are situated radially or axially in the piston barrel are provided between the working chamber and a pressure connection in order to discharge the pressure medium.

The disadvantage of a piston machine of this type is that the inclined bores provided in the piston foot for supplying the pressure medium are only capable of allowing a limited volumetric flow to take place, and so filling problems may occur, at high rotational speeds in particular. A further disadvantage of this known solution is that a valve design of this type is extremely complicated due to the placement of the suction and pressure valves in the piston and/or in the working chamber between the piston, thereby requiring a complex housing design.

SUMMARY OF THE INVENTION

The object of the present invention, therefore, is to create a hydraulic piston machine in which the hydraulic losses are minimized using a minimum of device-related outlay.

According to the present invention, the piston machine includes a plurality of pistons which are driven by a drive/output shaft, are guided in an axially displaceable manner in a piston barrel of a housing, and, in each case, bound one working chamber into which the pressure medium may be fed via a suction valve, and from which the pressure medium may be discharged via a pressure valve, the housing including at least one other housing part which is connected to the piston barrel on the front side. According to the present invention, the suction valves and pressure valves are situated in the region of a parting plane between the housing parts in housing receptacles, approximately axially parallel to the longitudinal axis of the piston machine. In this solution, the pressure medium is supplied via suction valves which are situated axially in the housing, thereby enabling the pressure medium channels to be easily designed in accordance with the desired volumetric flow rate of the piston machine and effectively preventing filling problems of the piston machine. As a result, in contrast to the prior art according to DE 10 2004 060 954 A1, the need to form a plurality of inclined bores which exist in the prior art mentioned initially—in the pistons is eliminated. Assembly of the axial piston machine is particularly simple since the valves in the region of the parting plane are inserted in receptacles in the housing parts.

According to a particularly preferred embodiment of the present invention, the suction and pressure valves are each inserted, at least in sections, in a recess of the piston barrel. The pressure valves are preferably situated on a partial circle having a larger diameter than that of a partial circle of the suction valves.

Preferably, the further housing part is designed as a connection part having at least one suction and pressure connection. Given that the suction and pressure connections are situated in a common housing part, the number of complex housing parts is minimized.

In an embodiment according to the present invention, a closing body of each suction valve is preloaded—via at least one closing spring which bears against the piston barrel—against a valve seat of a seat ring inserted in the piston barrel, and the seat ring bears against a front side of the housing part. It is advantageous that the seat rings are each retained in the receptacle of the piston barrel by the housing part, thereby eliminating the need for further fastening means. It is preferable for the closing spring to bear against a support surface of the piston barrel which is recessed in a stepped manner.

A valve body of the pressure valves is preferably preloaded via a compression spring against a valve seat formed in the receptacle of the piston barrel, the compression spring bearing against a spring plate which has been inserted in the receptacle at least in sections, and the spring plate bearing against a support shoulder of the housing part. It is advantageous that the spring plates are retained by the housing part in the receptacle of the piston barrel, thereby eliminating the need for further fastening means.

The spring plate situated in the region of the parting plane between the housing parts is preferably designed as a sealing element between the connection part and the piston barrel, thereby eliminating the need to provide any further seals in this region. In a preferred embodiment, the spring plate includes at least one recess, e.g. a through-bore, which forms a pressure-medium flow path.

The closing- and valve bodies are preferably provided with a front side which is approximately hemispherical in shape, at least in sections. Since the front sides are curved, a good sealing effect is attained when the valves are in the closed position, and a greatly reduced flow resistance is attained when the valves are in their opened position.

The closing- and valve bodies preferably include at least one recess. According to one embodiment of the present invention, the closing and valve-bodies are provided with an approximately cylindrical recess in which an end section of the closing- and/or compression spring enters and is retained therein. In particular, the cylindrical recess is designed to be somewhat smaller than the spring diameter of the closing- and/or compression springs, and so the closing- and valve bodies are held against the spring via an interference fit. The springs preferably form a guide for the closing- and valve bodies in the receptacle of the piston barrel.

According to one variant according to the present invention, the closing- and valve bodies include an axial collar which is annular in shape at least in sections, and which is enclosed by the end section of the closing- or compression spring, and is retained therein. The annular collar is preferably designed to be somewhat larger than the spring inner diameter of the closing- or compression spring, and so the closing- and valve bodies are held against the spring via an interference fit.

It has proven particularly advantageous to form the axial collar out of a plurality of axial projections which are situated on a common partial circle and are elastically deformable inwardly when high loads are applied. As a result, stresses which occur in the closing- and valve bodies may be minimized to a considerable extent, thereby preventing cracks from forming even in the presence of high pressure.

In one embodiment according to the present invention, the piston machine includes pistons which are movable in opposing directions and bound a common working chamber, and which are preloaded using at least one common tension spring against a swash or wobble plate via a sliding block in each case, each of the end sections of the tension spring bearing against a stop shoulder of a piston insert of the pistons. The piston inserts reduce the space inside the pistons, thereby minimizing the dead volume. Due to the tension springs, it is possible to eliminate as compared with the prior art according to DE 10 2004 060 954.3—spring-preloaded return plates for preloading the sliding blocks against the swash or wobble plates.

The weight of the piston machine may be reduced by manufacturing at least the valve body, closing body, spring plate, seat ring, pistons, and/or piston inserts of a wear-resistance plastic, e.g. a carbon fiber-reinforced plastic. Due to the reduced inertia attained via the weight optimization, the efficiency of the piston machine is improved. Moreover, noise is reduced considerably via the relatively soft actuation of the valve elements and the small dead volume. The spring plate which is situated in the region of the parting plane between the housing parts and is designed as a sealing element between the connection part and the piston barrel is preferably manufactured of a non-reinforced polyoxymethylene (POM) which has high stiffness and excellent resiliency, and so has a good sealing effect.

It has proven particularly advantageous in terms of fabrication to manufacture the plastic components of the piston machine via injection-moulding. The amount of mechanical reworking of the components required as a result is therefore reduced to a minimum or may be eliminated entirely, thereby making it possible to manufacture the piston machine in a cost-effective manner.

In a particularly preferred embodiment, the piston machine is designed as a dual wobble-plate machine or a dual inclined-piston machine, thereby compensating for axial forces. Advantageously, the piston machine may be operated in both directions of rotation.

BRIEF DESCRIPTION OF THE DRAWINGS

Preferred exemplary embodiments are explained below in greater detail with reference to the schematic drawing.

DETAILED DESCRIPTION OF THE PREFERRED EMBODIMENTS

Figure 1:
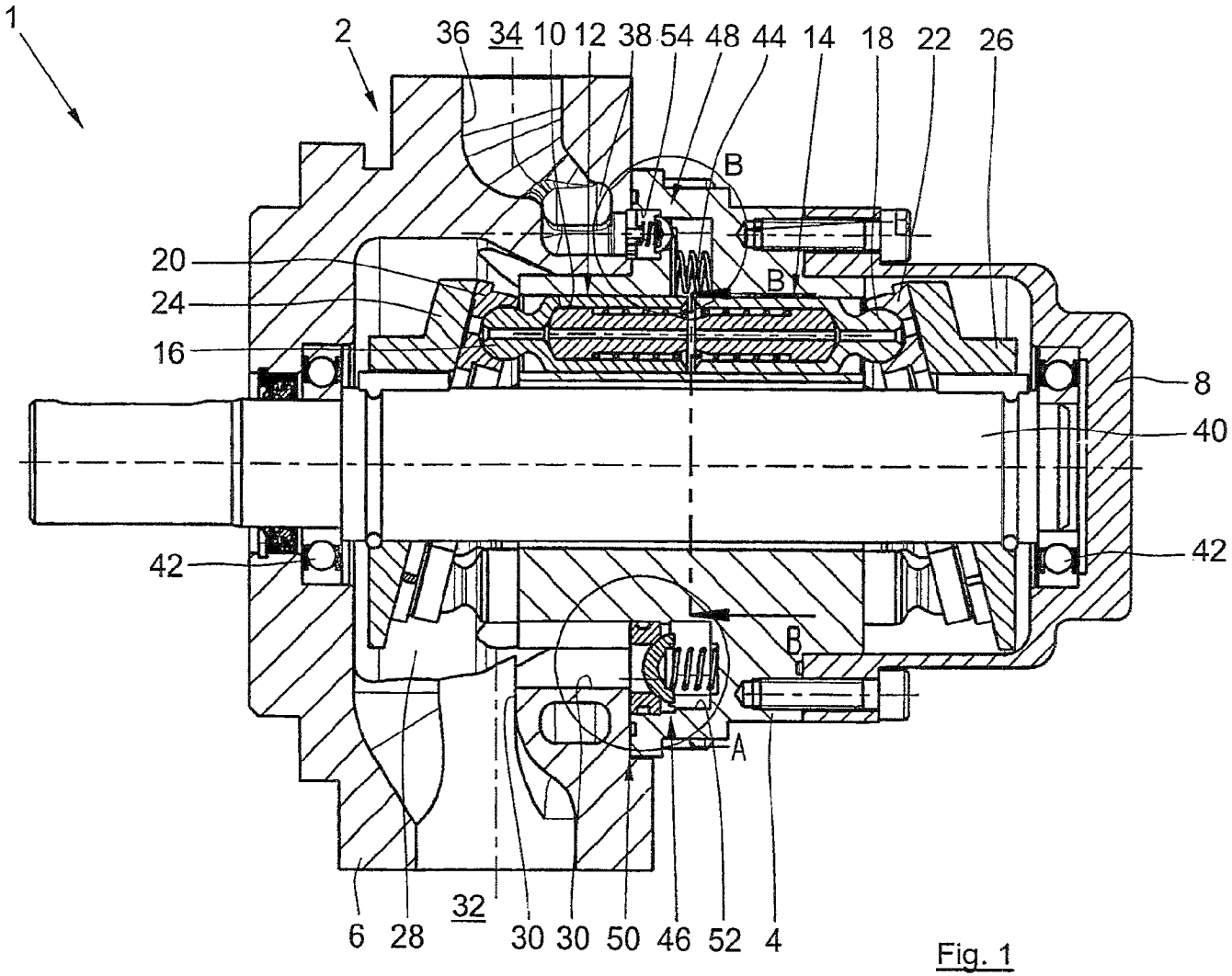
FIG. 1 shows a longitudinal cross section through a valve-controlled, dual wobble-plate machine.

A longitudinal view of a dual wobble-plate pump 1 is shown in FIG. 1. A pump 1 of this type includes a housing 2 which is composed essentially of a stationary piston barrel 4 and another housing part 6 which abuts piston barrel 4 on the front side. Piston barrel 4 is provided with a housing cover 8 on its front side facing away from housing part 6. Piston barrel 4 is penetrated by a large number of axially parallel cylindrical bores 10 which are situated on a common partial circle, each cylindrical bore 10 leading into the front sides of piston barrel 4 and accommodating two pistons 12, 14 which are movable in opposing directions. Pistons 12, 14 each extend via a piston foot 16, 18 out of particular front side of piston barrel 4. Piston feet 16, 18 are spherical in design, and each carry a sliding block 20, 22. Via sliding blocks 20, pistons 12 which extend out of the left (as viewed in FIG. 1) front side of piston barrel 4 bear against a first wobble plate 24, and pistons 14 which extend out of the right front side via sliding blocks 22 bear against a second wobble plate 26. Wobble plate 24 is situated in a suction chamber 28 of the further housing part which is designed as connection part 6, and which leads into a suction connection 32 via a suction channel 30. Connection part 6 is also provided with a pressure connection 34 which leads into a pressure chamber 38 via a pressure channel 36. Given that suction and pressure connections 32, 34 are situated in a common connection part 6, the number of complex housing parts is minimized. Wobble plates 24, 26 are non-rotatably connected to a drive shaft 40 of wobble plate pump 1, and each is supported via an axial/radial bearing 42 in connection part 6 and in housing cover 8. In a design of this type having symmetrically situated wobble plates 24, 26, the axial forces which occur are introduced symmetrically into drive shaft 40 and are carried by it, thereby eliminating the loads on housing 2 and bearing 42 from the moving parts, and thereby enabling housing 2 and bearing 42 to be designed smaller in size than is the case with a simple wobble plate pump having only one wobble plate.

A working chamber 44 which increases in size due to the opposing piston motion which takes place during the suction stroke, and which decreases in size during the compression stroke is bounded in the axial direction by the end sections—which face one another—of pistons 12, 14, each of which is accommodated in a cylindrical bore 10; pressure medium may be supplied to working chamber 44 via a suction valve 46 and removed therefrom via a pressure valve 48. As described in greater detail, below, pressure valves 48 and suction valves 46 are situated in housing receptacles 52, 54, axially parallel to the longitudinal axis of wobble plate pump 1 in the region of a parting plane 50 between housing parts 4, 6. In this solution, the pressure medium is supplied by suction valves 46 which are situated axially parallel to the housing longitudinal axis, via suction channels 30 and suction chamber 28 which may be designed in accordance with the desired volumetric flow rate of piston machine 1, thereby effectively preventing filling problems from occurring. Pump 1 is particularly simple to assemble since valves 46, 48 in the region of parting plane 50 are each inserted into a receptacle 52, 54 of piston barrel 4, receptacles 52, 54 being connected to working chamber 44.

Figure 2:
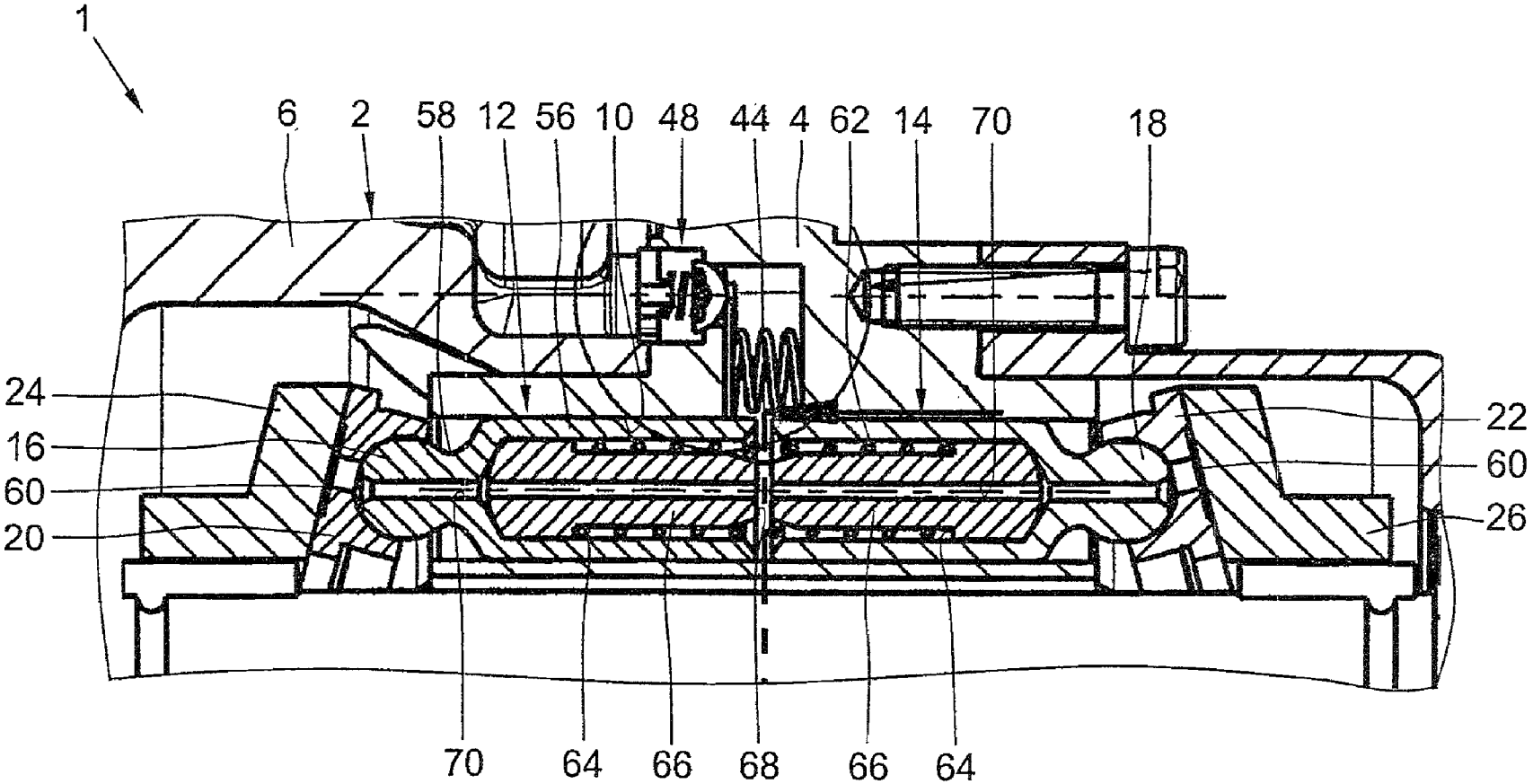
FIG. 2 shows a partial view of the wobble plate pump in FIG. 1.

FIG. 2 shows a partial depiction of wobble plate pump 1 in FIG. 1, including both pistons 12, 14 which are accommodated in a cylindrical bore 10. Pistons 12, 14 are shown at outer dead center, and a pressure valve 48 is shown in its closed position. Each piston 12, 14 includes an approximately cylindrical piston skirt 56 which transitions via a constriction 58 into spherical piston foot 16 (the pistons on the other side are identical in design, and so a description of them is not provided). Piston foot 16 is engaged in the manner of a ball joint in assigned sliding block 20 which bears via its sliding surface 60 against the front side of wobble plate 24. Pistons 12, 14 are preloaded by at least one common tension spring 62 against wobble plates 24, 26 via sliding blocks 20, 22, thereby preventing sliding blocks 20, 22 from being lifted off of assigned wobble plate 24, 26 during the suction stroke. The end sections of tension spring 62 each bear against an axially recessed stop shoulder 64 of a piston insert 66 of pistons 12, 14. Piston inserts 66 are adapted in sections to the inner diameter of cylindrical piston skirt 56 and are flush with a front-side plane 68 of pistons 12, 14 on the working-chamber side, thereby reducing the space inside pistons 12, 14 and, therefore, the dead volume. To reduce friction and hydrostatically support sliding blocks 20, 22, a through-bore 70 extends through piston insert 66, pistons 12, 14, and sliding blocks 20, 22; through-bore 70 transitions into a funnel-shaped expansion in working chamber 44 at one end, and into sliding surface 60 at the other end. This is necessary to maintain the pressure medium connection to sliding surface 60 also during the relative swiveling between sliding block 20, 22 and pistons 12, 14 depicted in FIG. 2.

Figure 3:
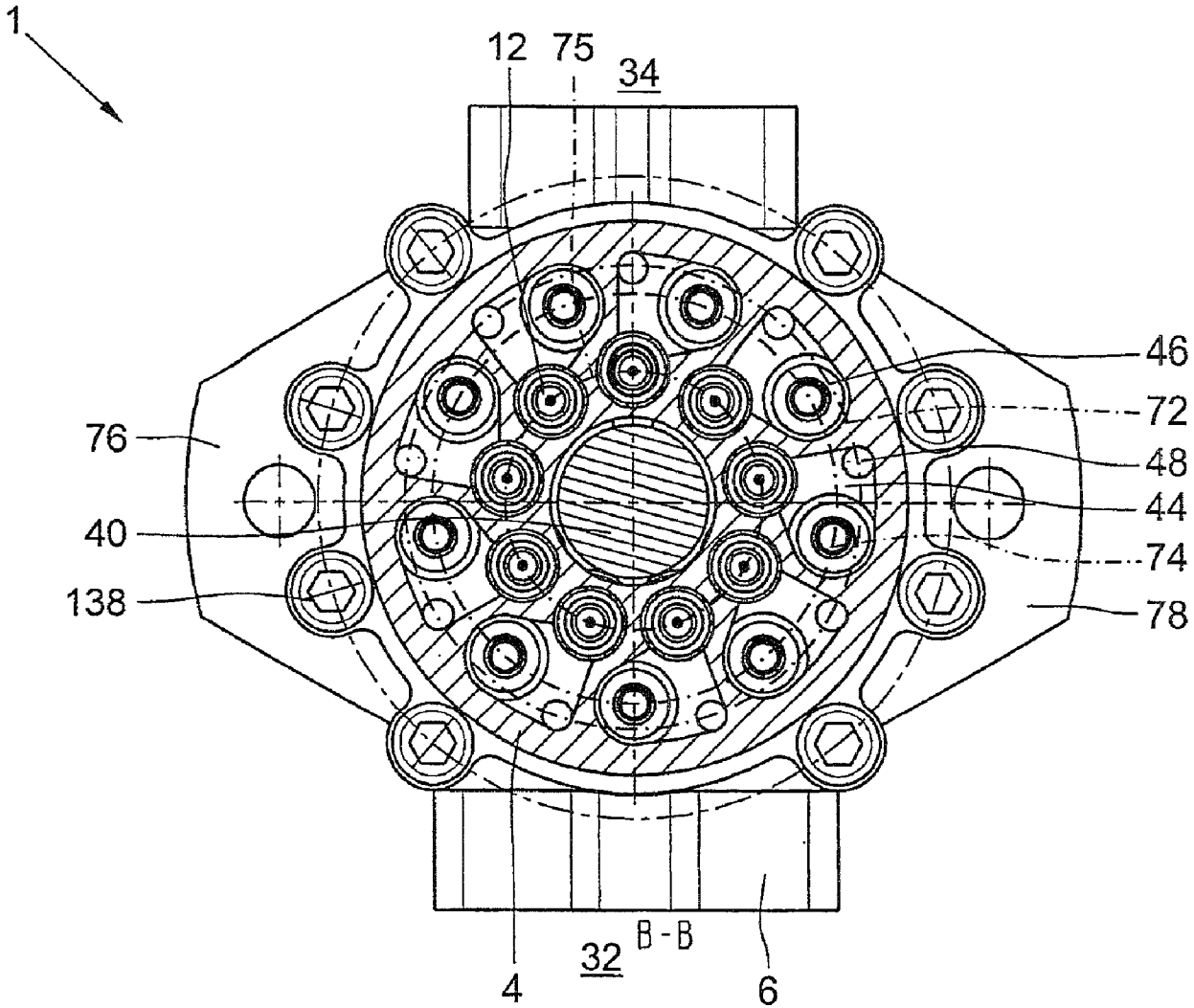
FIG. 3 shows a sectional view along line B-B in FIG. 1.

FIG. 3 shows a sectional view along line B-B in FIG. 1, according to which pressure valves 48 are situated on a common partial circle 72 having a larger diameter than that of a common partial circle 74 of suction valves 46. Partial circle 75 of pistons 12 is situated between drive shaft 40 and partial circle 74 of suction valves 46. In this embodiment, one suction valve 46 and one pressure valve 48 are assigned to each working chamber 44. Connection part 6 is provided with two diametrically opposed flanges 76, 78 for attachment to wobble plate pump 1.

Figure 4:
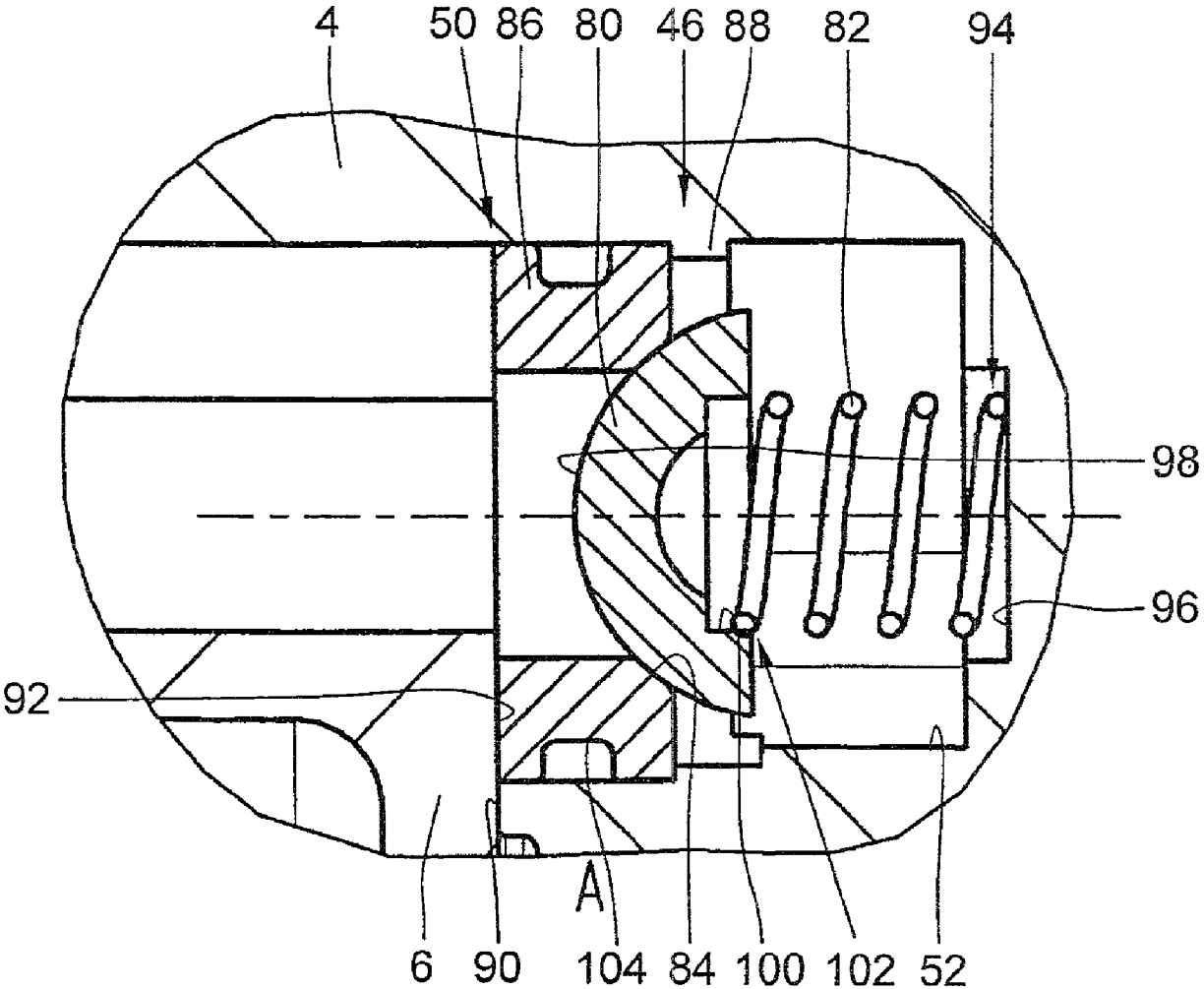
FIG. 4 shows an enlarged view of section A in FIG. 1.

As depicted in FIG. 4 which shows an enlarged view of section A in FIG. 1, suction valves 46 each includes a closing body 80 which is preloaded—via a closing spring 82 bearing against piston barrel 4—against a valve seat 84 of a seat ring 86 which is inserted in receptacle 52 of piston barrel 4. To this end, receptacle 52 is stepped in design, the geometry of a step section 88 being selected in such a manner that seat ring 86 extends in an approximately flush manner with a front-side mating surface 90 of piston barrel 4, and bears against a front side 92 of connection part 6 and is held by connection part 6 in receptacle 52, thereby eliminating the need for further fastening means. Closing spring 82 bears via a first end section 94 against a stepwise-recessed support surface 96 of piston barrel 4. Closing body 80 is preloaded against valve seat 84 using an approximately hemispherical front side 98 via the force of closing spring 82. Closing body 80 includes an approximately cylindrical recess 100 on the back side, into which a second end section 102 of closing spring 82 enters and is retained therein. The diameter of cylindrical recess 100 is designed to be approximately smaller than the diameter of closing spring 82, so that closing body 80 is held against closing spring 82 via an interference fit, and is guided in recess 52 of piston barrel 4. Seat ring 86 is provided with a circumferential, approximately U-shaped annular groove 104 for accommodating a seal which is not depicted.

Figure 5:
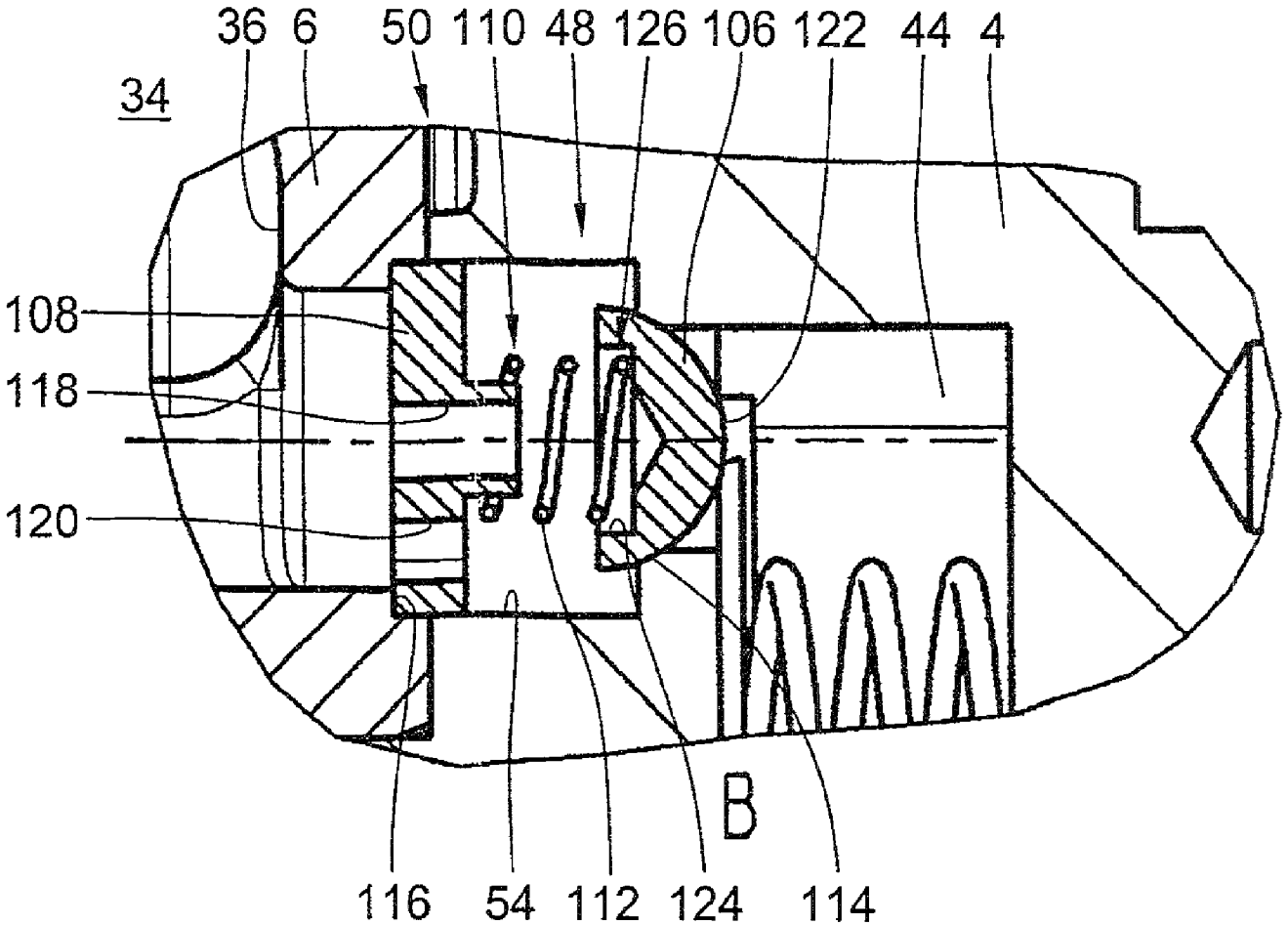
FIG. 5 shows an enlarged view of section B in FIG. 1.

As shown in FIG. 5 in particular, which is an enlarged view of section B in FIG. 1, pressure valves 48 are likewise designed as seat valves; a valve body 106 of pressure valves 48 is preloaded against a valve seat 114 formed in stepped recess 54 of piston barrel 4 via a compression spring 112 which bears via a first end section 110 against a spring plate 108 inserted in receptacle 54 in sections. As a result, backflow from pressure connection 34 via pressure channel 36 to working chamber 44 is prevented. Spring plate 108 bears against a support shoulder 116 of connection part 6, and so support shoulder 116 is held by connection part 6 against the force of compression spring 112 in receptacle 54 of piston barrel 4. Spring plate 108 situated in the region of parting plane 50 between housing parts 4, 6 is designed as a sealing element, thereby eliminating the need to provide any further seals in this region. Spring plate 108 includes at least two recesses 118, 120, e.g. through-bores, which form a pressure-medium flow path. Valve body 106 is provided with an approximately hemispherical front side 122, and it includes an approximately cylindrical recess 124 on the back side, into which a second end section 126 of compression spring 112 enters and is retained therein. The diameter of cylindrical recess 124 is designed to be approximately smaller than the diameter of compression spring 112, so that valve body 106 is held against compression spring 112 via an interference fit, and is guided in recess 54 of piston barrel 4. Since front sides 122 are curved, a good sealing effect is attained when pressure valves 48 are in the closed position, and a greatly reduced flow resistance is attained when pressure valves 48 are in their opened position.

Figure 6:
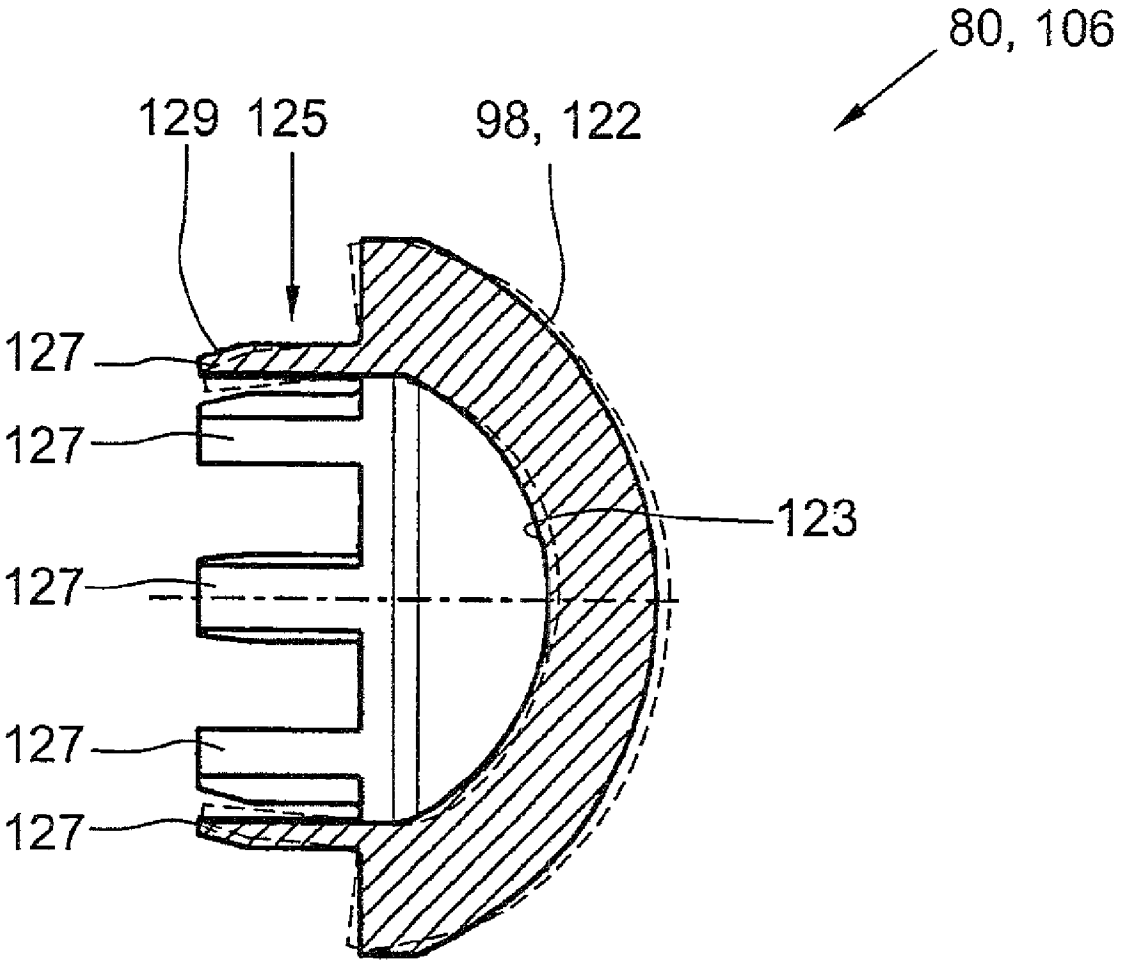
FIG. 6 shows an isolated view of a closing- or valve body according to a second embodiment according to the present invention.

As depicted in FIG. 6 which shows an isolated view of a closing body 80 or valve body 106 according to a second embodiment according to the present invention, they are provided with an approximately hemispherical recess 123 on their back sides, and with an axial collar 125 that is annular in shape, at least in sections, axial collar 125 being enclosed by end section 102, 126 of closing- and compression springs 82, 112 (see FIG. 4 and FIG. 5, respectively), and being retained therein. To this end, the diameter of annular collar 125 is designed to be approximately larger than the inner diameter of compression spring 82, 112, so that closing body 80 and/or valve body 106 is held against compression spring 82, 112 via an interference fit, and is guided in the recess of piston barrel 4. It has proven particularly advantageous to form axial collar 125 out of a plurality of finger-shaped axial projections 127 which are indicated via a dashed line and are elastically deformable inwardly when high loads are applied on closing body 80 and valve body 106. As a result, even when pressures are high, stresses which occur in closing- and valve bodies 80, 106 may be minimized to a considerable extent, thereby effectively preventing cracks from forming. The axial projections are each provided with an outwardly situated insertion bevel 129 to simplify installation of the spring.

Figure 7:
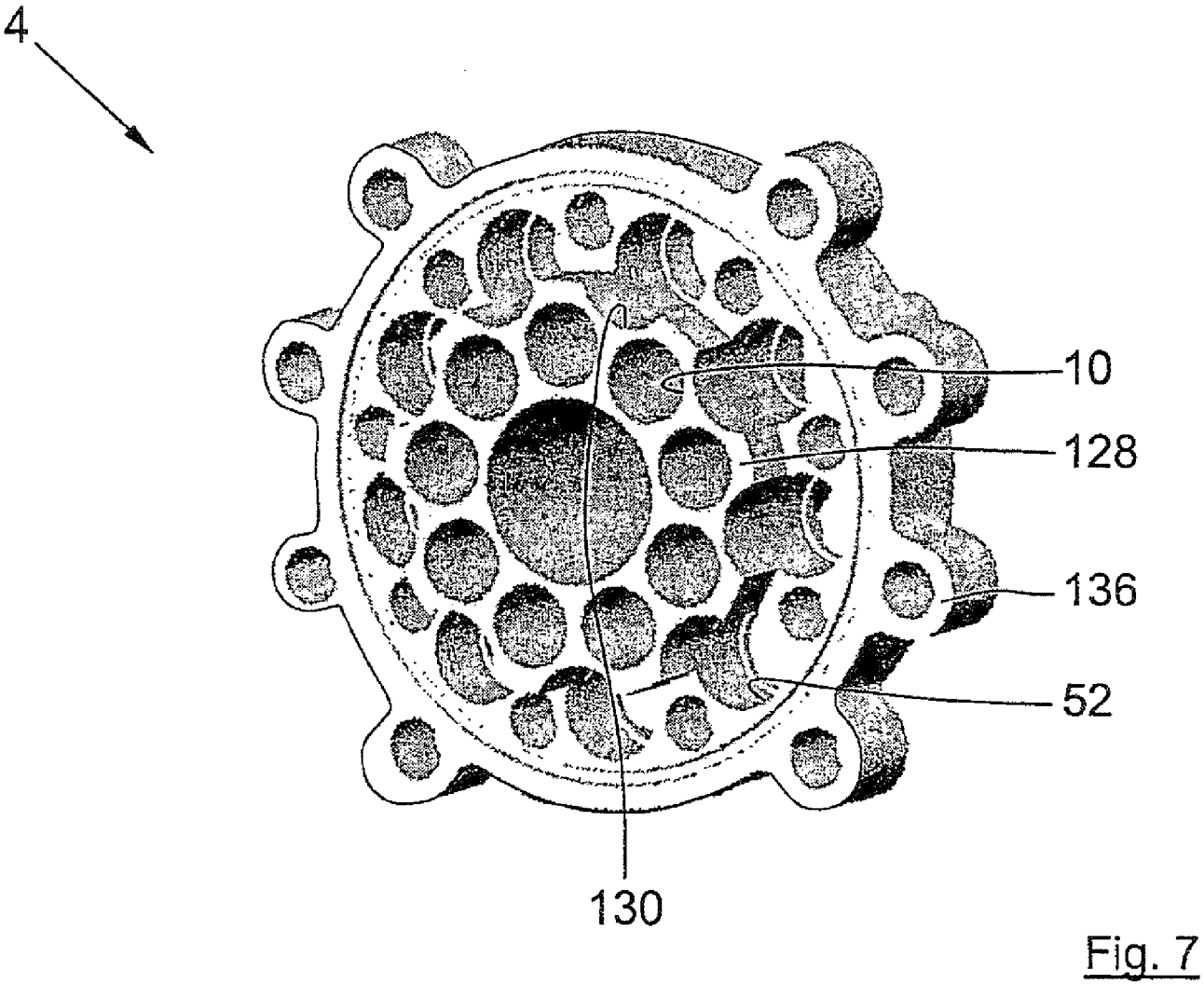
FIG. 7 shows an isolated view of the piston barrel in FIG. 1.

As depicted in FIG. 7 which shows an isolated view of piston barrel 4 in FIG. 1, piston barrel 4 includes an essentially cylindrical body having an axial collar 128 in which cylindrical bores 10 are formed. Bore sections 130 extend through the edge of axial collar 128 and make it possible to slide seat rings 86 of suction valves 46 into stepped recesses 52, and which, together with a bore part 132 of connection part 6 (see FIG. 8) form a part of suction channel 30 (see FIG. 1). On its outer circumference, piston barrel 4 is provided with fastening tabs 136 for receiving fastening screws 138 (see FIG. 3) to fasten piston barrel 4 to connection part 6.

Figure 8:
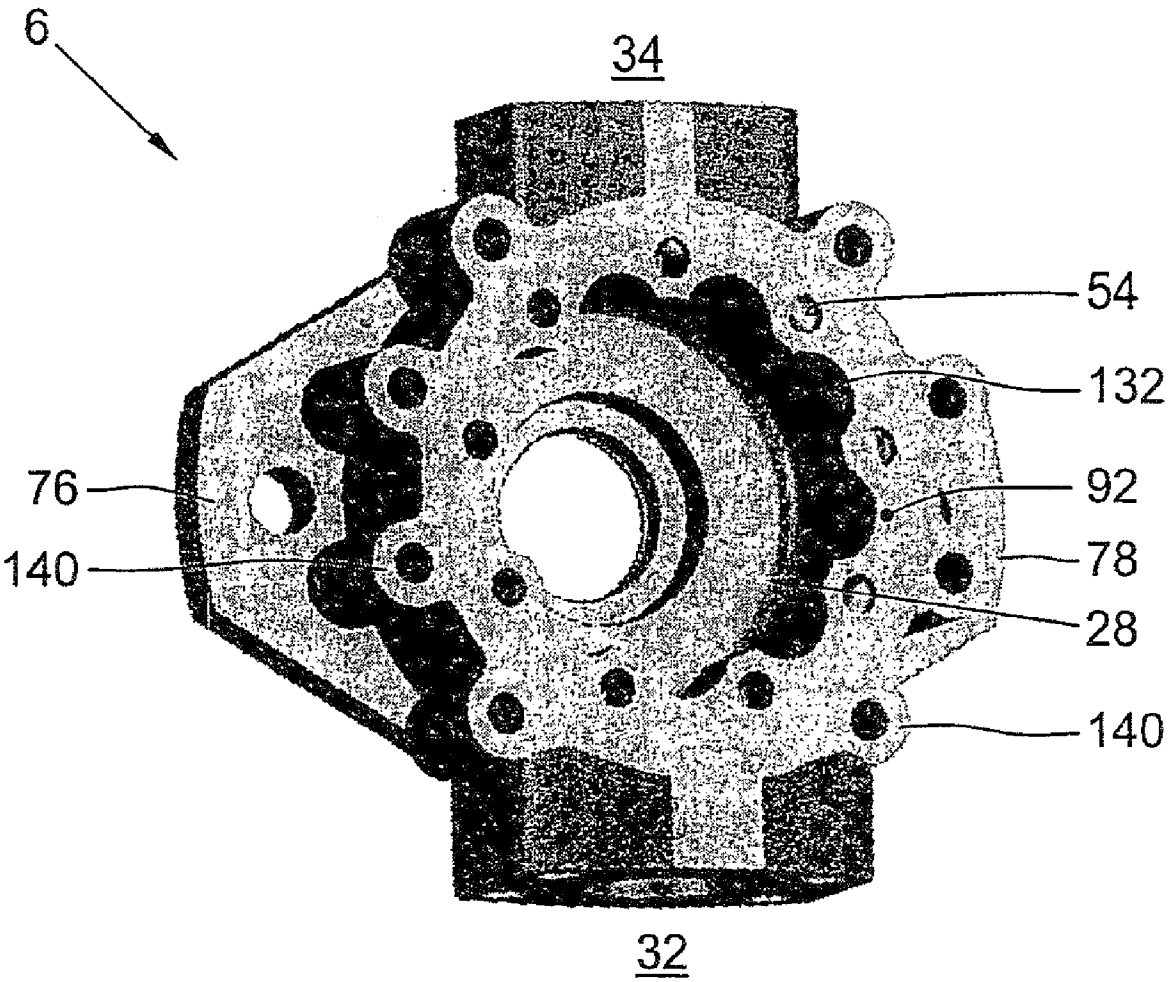
FIG. 8 shows an isolated view of the connection part in FIG. 1.

FIG. 8 shows an isolated view of connection part 6 in FIG. 1, in which suction chamber 28 includes bore parts 132 which extend through its inner circumferential walls, join bore sections 130 (see FIG. 7) to form a subregion of suction channel 30, and, together with front side 92, hold seat rings 86 of suction valves 46 and spring plates 108 of pressure valves 48 in receptacle 52, 54 of piston barrel 4 (see FIG. 4 and FIG. 5). To attach piston barrel 4, connection part 6 is provided with fastening tabs 140 on its outer circumference for receiving fastening screws 138 (see FIG. 3).

An unusual feature of the solution described is that at least closing body 80, valve body 106, spring plate 108, seat ring 86, pistons 12, 14, and piston inserts 66 are composed of wear-resistant plastic, e.g. carbon fiber-reinforced PEEK, and so dual wobble-plate pump 1 is designed to have a minimal weight and a minimum of moving masses. The components mentioned above are preferably manufactured via injection-moulding, it being possible to integrally form sliding blocks 20, 22 directly on assigned pistons 12, 14. The design according to the present invention, which includes components manufactured of plastic, simplifies the manufacture of pump 1 since practically no finishing work is required for these components. Moreover, noise is reduced considerably via the relatively soft actuation of the valve elements and the small dead volume. Dual wobble-plate pump 1 described above may be operated in both directions of rotation without being retrofitted.

Piston machine 1 according to the present invention is not limited to the embodiment described. Instead, working machine 1 may be designed as a single wobble-plate pump, in which only pistons 12 are guided in an axially displaceable manner in piston barrel 4, and pistons 12 bear against sole wobble plate 24 via sliding blocks 20. In a solution of this type, pressure forces are applied to housing 2 on one side, although the advantage is that pump 1 is shorter in design in the axial direction.

Disclosed herein is a hydraulic piston machine 1 which includes a plurality of pistons 12, 14 which are driven by a drive/output shaft 40, are guided in an axially displaceable manner in a piston barrel 4 of a housing 2, and, in each case, bound one working chamber 44 into which the pressure medium may be fed via a suction valve 46, and from which the pressure medium may be discharged via a pressure valve 48, housing 2 including at least one other housing part 6 which is connected to piston barrel 4 on the front side. According to the present invention, suction valves 46 and pressure valves 48 are situated in the region of a parting plane 50 between housing parts 4, 6 in housing receptacles 52, 54, axially parallel to the longitudinal axis of piston machine 1.

What is claimed is:

1. A hydraulic piston machine, comprising:

a plurality of pistons (12, 14) which are driven by a drive/output shaft (40), guided in an axially displaceable manner in a piston barrel (4) of a housing (2), and, in each case, bound one working chamber (44) into which the pressure medium may be fed via a suction valve (46), and from which the pressure medium may be discharged via a pressure valve (48), wherein the housing (2) comprises at least one further housing part (6) which is connected to the piston barrel (4) on the front side, wherein the suction valves (46) and pressure valves (48) are situated in the region of a parting plane (50) between the housing parts (4, 6), in housing receptacles (52, 54), approximately axially parallel to the longitudinal axis of the piston machine, and wherein the pressure valves (48) are situated on a common partial circle (72) having a larger diameter than that of a common partial circle 74 of the suction valves (46), wherein a partial circle (75) of the pistons (12) is situated between drive/output shaft (40) and the partial circle (74) of the suction valves (46), wherein a closing body (80) of each suction valve (46) is preloaded via at least one closing spring (82) bearing against the piston barrel (4), against a valve seat (84) of a seat ring (86) inserted in the piston barrel (4); seat ring (86) bears against a front side (92) of the housing part (6).

2. The piston machine as recited in claim 1, in which the suction and pressure valves (46, 48) are each inserted, at least in sections, in a recess (52, 54) of the piston barrel (4).

3. The piston machine as recited in claim 1, in which the pressure valves (48) are situated in the piston barrel (4) on a partial circle (72) having a larger diameter than that of a partial circle (74) of the suction valves (46).

4. The piston machine as recited in claim 1, in which the housing part (6) is designed as a connection part and includes at least one suction and pressure connection (32, 34).

5. The piston machine as recited in claim 1, in which the closing spring (82) bears against a support surface (96) of the piston barrel (4) which is recessed in a stepped manner.

6. The piston machine as recited in claim 1, in which a valve body (106) of the pressure valves (48) is preloaded via at least one compression spring (112)—which bears against a spring plate (108) inserted, at least in sections, in the receptacle (54)—against a valve seat (114) formed in the receptacle (54) of the piston barrel (4); the spring plate (108) bears against a support shoulder (116) of the housing part (6).

7. The piston machine as recited in claim 6, in which the spring plate (108) lies in the parting plane (50) as a seal.

8. The piston machine as recited in claim 6, in which the spring plate (108) includes at least one recess (118, 120), in particular a through-bore, which forms a pressure-medium flow path.

9. The piston machine as recited in claim 1, in which the closing- and/or valve body (80, 106) include(s) a front side (98, 122) which is approximately hemispherical in shape, at least in sections.

10. The piston machine as recited in claim 1, in which the closing- and/or valve body (80, 106) include(s) at least one recess (100, 123, 124).

11. The piston machine as recited in claim 1, comprising an approximately cylindrical recess (100, 124), in which an end section (102, 126) of a closing- and compression spring (82, 112) enters the recess (100, 124) and is retained therein.

12. The piston machine as recited in claim 1, in which the closing valve body (80, 106) include(s) an axial collar (125) which is annular in shape, at least in sections, is enclosed by an end section (102, 126) of the closing- or compression spring (82, 112), and is retained therein.

13. The piston machine as recited in claim 12, in which the axial collar (125) is formed by a plurality of axial projections (127) situated on a common partial circle.

14. The piston machine as recited in claim 1, comprising pistons (12, 14) which are movable in opposing directions and bound the common working chamber (44), and which are preloaded using at least one common tension spring (62) against a swash or wobble plate (24, 26) via a sliding block (20, 22) in each case; each of the end sections of the tension spring (62) bears against a stop shoulder (64) of a piston insert (66) of the pistons (12, 14).

15. The piston machine as recited in claim 1, wherein at least the valve body (106), closing body (80), spring plate (108), seat ring (86), pistons (12, 14) and/or piston inserts (66) are manufactured of plastic in the form of a carbon fiber-reinforced plastic.

16. The piston machine as recited in claim 1, in which the spring plate (108) is manufactured of non-reinforced polyoxymethylene (POM).

17. The piston machine as recited in claim 1, in which the components (106, 80, 108, 86, 12, 14, 66) mentioned in claim 16 are manufactured via injection-moulding.

* * * * *